US009157240B2

(12) United States Patent
Halischuk

(10) Patent No.: US 9,157,240 B2
(45) Date of Patent: Oct. 13, 2015

(54) APPARATUS FOR TRIMMING INTERIOR WALLS

(71) Applicant: Cory Halischuk, Clandeboye (CA)

(72) Inventor: Cory Halischuk, Clandeboye (CA)

( * ) Notice: Subject to any disclaimer, the term of this patent is extended or adjusted under 35 U.S.C. 154(b) by 0 days.

(21) Appl. No.: 14/061,857

(22) Filed: Oct. 24, 2013

(65) Prior Publication Data

US 2014/0174023 A1 Jun. 26, 2014

Related U.S. Application Data

(62) Division of application No. 13/324,448, filed on Dec. 13, 2011, now abandoned.

(60) Provisional application No. 61/432,341, filed on Jan. 13, 2011, provisional application No. 61/442,418, filed on Feb. 14, 2011, provisional application No. 61/454,616, filed on Mar. 21, 2011, provisional application No. 61/565,809, filed on Dec. 1, 2011.

(51) Int. Cl.

| | |
|---|---|
| ***E04F 13/21*** | (2006.01) |
| ***E04F 19/04*** | (2006.01) |
| *E04F 13/073* | (2006.01) |
| *E04F 13/07* | (2006.01) |

(52) U.S. Cl.

CPC ..... *E04F 13/21* (2013.01); *E04F 19/0481* (2013.01); *E04F 19/0495* (2013.01); *E04F 2019/0454* (2013.01)

(58) Field of Classification Search

CPC ... E04F 13/21; E04F 19/0495; E04F 19/0481; E04F 2019/0454

USPC ..... 52/287.1, 288.1, 290, 312, 716.1, 52/716.2, 716.3, 716.4, 716.8, 717.01, 52/717.02, 717.03, 717.04, 717.05, 52/717.06, 718.01, 718.02, 718.04, 718.05

See application file for complete search history.

(56) References Cited

U.S. PATENT DOCUMENTS

| | | | | |
|---|---|---|---|---|
| 3,148,419 | A * | 9/1964 | Straus et al. | 49/469 |
| 3,681,887 | A | 8/1972 | Loew | |
| 3,775,926 | A | 12/1973 | Brown et al. | |
| 3,956,861 | A | 5/1976 | Rasmussen | |
| 5,463,835 | A | 11/1995 | Wood | |
| 5,595,427 | A * | 1/1997 | Peters et al. | 312/140.4 |

(Continued)

FOREIGN PATENT DOCUMENTS

| | | |
|---|---|---|
| CA | 2244865 | 2/1996 |
| CA | 2411491 | 6/2004 |

*Primary Examiner* — James Ference
*Assistant Examiner* — Joseph J Sadlon
(74) *Attorney, Agent, or Firm* — Adrian D. Battison; Ade & Company Inc.

(57) ABSTRACT

A system for trimming interior walls includes a plurality of elongate boards forming both base boards and fenestration casing boards for mounting on a respective wall along an edge of the wall for forming an attractive edge face of the wall. Each board has a front face with a continuously longitudinally extending groove with the rear face of the board being fastened to the wall by a series of screws at spaced positions along the board with the screws being recessed in the groove. An extruded plastic strip is inserted into the groove along the length of the board so as to cover the groove and the screws therein. The casing boards include an extra fastening connector along the rear of the board at the jamb. Corner pieces are provided which are hollow moldings to cover the ends of the boards with either a groove for a part of the strip or a simulated ridge matching the strip.

15 Claims, 13 Drawing Sheets

(56) References Cited

U.S. PATENT DOCUMENTS 5,979,132 A * 11/1999 Margarit ..... 52/312
6,148,584 A * 11/2000 Wilson ..... 52/717.01
6,807,783 B2 * 10/2004 Lee ..... 52/473
2002/0121067 A1 * 9/2002 Nien et al. ..... 52/717.01
2002/0127368 A1 * 9/2002 Richardson ..... 428/99
2004/0139667 A1 * 7/2004 Massey et al. ..... 52/204.1
2008/0172956 A1 * 7/2008 Boldt et al. ..... 52/204.1

* cited by examiner

APPARATUS FOR TRIMMING INTERIOR WALLS

This application is a divisional application of application Ser. No. 13/324,448 filed Dec. 13, 2011.

This application claims the benefit of priority under 35 USC 119 of Provisional Application 61/432,341 filed Jan. 13, 2011.

This application claims the benefit of priority under 35 USC 119 of Provisional Application 61/442,418 filed Feb. 14, 2011.

This application claims the benefit of priority under 35 USC 119 of Provisional Application 61/454,616 filed Mar. 21, 2011.

This application claims the benefit of priority under 35 USC 119 of Provisional Application 61/565,809 filed Dec. 1, 2011.

This invention relates to an apparatus for trimming interior walls and particularly a method and arrangement for fastening a board to a wall at a fenestration opening at a door or window casing.

BACKGROUND OF THE INVENTION

Typically base boards, window and door casings and the like are fastened to a wall by finishing nails which then require to be patched with a filler and finish painted over the filler. Thus in most cases the boards are supplied in a prime paint condition so that the finish coat is applied simultaneously over the filler and the prime coat. This requires considerable labor to fill and paint the small holes left by the finish nails. Also it is generally not possible to remove the board for adjustment or to work on the adjacent wall or floor since the nails generally cause splitting of the board and prevent replacement of the board after it is removed.

SUMMARY OF THE INVENTION

It is one object of the invention to provide an improved arrangement for fastening the strip to the wall to provide a wall trimming system.

According to one aspect of the invention there is provided an apparatus for trimming interior walls of a building comprising:

a plurality of fenestration jamb members including a first and a second jamb member arranged at right angles for surrounding a fenestration opening;

each of the jamb members providing an front face located at an edge of one of the interior walls;

a plurality of elongate facing boards;

each facing board having a front face defining an attractive edge face and a rear face for fastening to the wall;

each of the first and second jamb members having associated therewith a respective first and second of the elongate facing boards mounted on a respective one of the interior walls along the edge of the wall for forming the attractive edge face of the wall;

each facing board having an inner edge facing inwardly along the wall and an outer edge located at the front face of the jamb member;

each facing board having in said front face of the board at a position spaced from the front face of the jamb member a continuously longitudinally extending groove;

the groove having a base recessed from the front face;

the groove having a first side edge in said front face at a position spaced from said inner edge of the board and a second side edge on said front face at a position spaced from the outer edge of the board;

the rear face of the board being fastened to the wall by a series of screws at spaced positions along the base of the groove of the board with the screws being recessed in the groove from the front face of the board;

and an extruded plastic strip inserted into the groove along the length of the board and covering the groove and the screws therein;

wherein the extruded plastic strip has a cap portion outside the groove and an insert portion extending into the groove;

the groove having a first a first side wall extending from the base to the first side edge and a second side wall extending from the base to the second side edge;

the first and second side walls being shaped to cooperate with a respective side edge of the insert portion of the extruded plastic strip to restrain the insert portion against movement out of the groove;

the cap portion having first and second side edges and an outer surface therebetween;

the first side edge of the cap portion being located on the front face of the board at a position spaced from the first side edge of the groove toward but spaced from said inner edge of the board;

the second side edge of the cap portion being located on the front face of the board at a position spaced from the second side edge of the groove toward but spaced from said outer edge of the board;

and a connection element, which is separate and spaced from the screws, connecting the board to the respective jamb member, the connection element including a component on the rear face of the board and a component on the jamb member.

Preferably the jamb member comprises a cut length of an extruded body. However it can also be formed of wood or other composite material.

Preferably the component on the jamb member comprises an element formed as an integral component of the extruded body.

Preferably the component on the rear surface of the facing board comprises a channel and the component on the jamb comprises an insert strip portion inserted into the channel as a friction fit.

Preferably the insert strip portion has arrow shaped fins engaging side walls of the channel.

Preferably the outer surface of the cap portion is domed in transverse cross-section so as to extend forwardly proud of the front face of the facing board.

Preferably the domed outer surface of the cap portion tapers to a sharp edge at the front face of the facing board.

Preferably the first and second facing boards have end portions thereof which come together at an angle at a corner and wherein there is provided a molded corner piece having a front face covering the front face of the end portions of the first and second boards, the front face of the corner piece providing a contiguous continuation between the front face of the first board and the front face of the second board.

Preferably the outer surface of the cap portion is domed in transverse cross-section so as to extend forwardly proud of the front face of the facing board and wherein the front face of the corner piece includes a molded ridge therein shaped to receive thereunder the outer domed surface of the cap portion of the strip.

Preferably the first and second side walls of the groove are tapered such that the spacing therebetween increases toward the base.

Preferably each of the first and second facing boards is a different color from the strip.

Preferably each of the first and second facing boards is extruded.

According to a second aspect of the invention there is provided an apparatus for trimming interior walls of a building comprising:

a plurality of fenestration jamb members including a first and a second jamb member arranged at right angles for surrounding a fenestration opening;

each of the jamb members providing an front face located at an edge of one of the interior walls;

a plurality of elongate facing boards;

each facing board having a front face defining an attractive edge face and a rear face for fastening to the wall;

each of the jamb members having associated therewith a respective one of the plurality of elongate facing boards mounted on a respective one of the interior walls along the edge of the wall for forming the attractive edge face of the wall;

a connection element for connection of the board to the respective jamb member including a component on the rear face of the board and a component on the jamb member;

wherein the jamb member comprises a cut length of an extruded body;

and wherein the component on the jamb member comprises an element formed as an integral component of the extruded body.

Preferably the component on the rear surface of the facing board comprises a channel and the component on the jamb comprises an insert strip portion inserted into the channel as a friction fit.

Preferably the insert strip portion has arrow shaped fins engaging side walls of the channel.

Preferably there is provided a separate attachment member separate from components and spaced from jamb member attaching the facing board to the wall at a position spaced from the jamb member.

Preferably the strip has an outer surface of the cap portion which tapers to an edge along respective sides of the groove.

Preferably the groove has reverse tapered sides so as to hold the insert portion of the strip as a snap fastening therein.

Preferably the strip is removable to allow the board to be unscrewed and removed to enable work to be carried out on the wall or adjacent floor and replaced at the same or an adjusted position.

Preferably the board is supplied in a finish paint condition.

In some cases the board is a different color from the strip to provide an attractive contrast. In other cases a matching color can be used.

The board with the groove therein can be an extruded plastics product or it can be cut from a wood product such as hard wood or MDF.

Where the board is a fenestration casing board for attachment along an edge of a fenestration opening in the wall, the board is preferably arranged for connection by the screws in the groove to a frame of the fenestration opening and there is provided a connection element for connection of the board to a jamb of the fenestration opening where the connection element includes a component on the rear surface of the board parallel to and spaced transversely of the groove.

In this case the connection element can include a component on the jamb defined by a strip which is fastened to the jamb and engages a receptacle on the board.

In some cases the component on the jamb comprises an element formed as an integral component of an extruded jamb.

In other cases the component on the rear surface of the board comprises a channel and the connection element includes a component on the jamb defined by an insert strip portion insertable into the channel as a friction fit, which insert strip portion is carried on an attachment flange member arranged for fastening along the jamb.

When used for casings, the strip is preferably pre-formed to length to define the four sides of a casing for a window or three sides for a door. This can avoid any cutting in the room to avoid the typical dust collection in building work Preferably two of the boards have ends coming together at an angle at a corner and there is provided a molded corner piece covering the ends of the first and second boards and providing a cover at the corner with a front face of the corner piece providing a contiguous continuation between the front face of the first board and the front face of the second board.

Preferably each of the boards has a contour of the front face and the front face of the molded corner piece follows the contour.

Preferably each of the boards has an edge face generally transverse to the front face and wherein the corner piece has an edge wall covering the edge face at an end of each board.

Preferably each of the boards has two opposed edge faces generally transverse to the front face on opposite sides of the front face and wherein the corner piece has two edge walls each covering the respective edge face at an end of each board.

When used for forming a casing for a fenestration opening in the wall where the boards meet at a corner of the casing the front face of the boards and the front face of the corner piece lie in a common plane parallel to the wall.

When used forming a baseboard along two walls at an angle to one another where the boards meet at a corner between two walls the front face corner piece includes two portions at the angle each overlying a respective one of the boards.

Preferably the corner piece is fastened to at least one of the boards by adhesive tape.

Preferably the corner piece is hollow so that at least one of the boards passes behind the front face.

Preferably the corner piece has a rear face fastened by adhesive to a front face of board.

In one arrangement of the corner piece, the front face of the corner piece includes a groove which is contiguous with the groove in the boards. In this case there is provided a molded plastic strip portion simulating the extruded plastic strip and arranged to engage into the groove of the corner piece. The groove in the corner piece can be shaped such that the extruded plastic strip extends from the groove in the board into the groove in the corner piece.

In another arrangement of the corner piece, the front face of the corner piece includes a molded ridge shaped to follow an outer face of the strip so as to simulate the strip.

According to another aspect of the invention there is an apparatus for forming a decorative strip to be fastened along an edge of one or more walls comprising:

a first and a second elongate stiff decorative strip each having a front face which is arranged to be exposed along the edge of the wall or walls;

a fastening system for fastening a rear face of the strip to the wall or walls along the edge of the wall or walls;

the first and second strips having ends coming together at an angle at a corner;

and a molded corner piece covering the ends of the first and second strips and providing a cover at the corner with a front face of the corner piece providing a contiguous continuation between the front face of the first strip and the front face of the second strip.

Preferably each of the strips has a contour of the front face and the front face of the molded corner piece follows the contour.

Preferably each of the strips has an edge face generally transverse to the front face and wherein the corner piece has an edge wall covering the edge face at an end of each strip.

Preferably each of the strips has two opposed edge faces generally transverse to the front face on opposite sides of the front face and wherein the corner piece has two edge walls each covering the respective edge face at an end of each strip.

In accordance with one arrangement for forming a casing for a fenestration opening in the wall where the strips meet at a corner of the casing wherein the front face of the strips and the front face of the corner piece lie in a common plane parallel to the wall.

In accordance with one arrangement for forming a baseboard along two walls at an angle to one another where the strips meet at a corner between two walls wherein the front face corner piece includes two portions at the angle each overlying a respective one of the strips.

Preferably the corner piece is fastened to at least one of the strips by adhesive tape.

Preferably the corner piece is hollow so that at least one of the strips passes behind the front face.

Preferably the corner piece has a rear face fastened by adhesive to a front face of strip.

In accordance with one preferred arrangement each strip has in the outer face of the strip a continuously longitudinally extending groove where a rear face of the strip is fastened to the wall by a series of screws at spaced positions along the strip, the screws being recessed in the groove and wherein in there is provided an extruded plastic strip arranged to be inserted into the groove along the length of the strip covering the groove and the screws therein. However the strips can be fastened by other fastening systems In accordance with one arrangement the front face of the corner piece includes a groove which is contiguous with the groove in the strips. In this case, preferably there is provided a molded plastic strip portion simulating the extruded plastic strip and arranged to engage into the groove of the corner piece. Preferably the groove in the corner piece is shaped such that the extruded plastic strip extends from the groove in the strip into the groove in the corner piece.

In accordance with one arrangement the corner piece is fastened to the wall by screws being recessed in the groove of the corner piece. Preferably the corner piece includes a support leg within the corner pieces to hold the corner piece from collapsing when the screws are inserted.

In accordance with one arrangement the front face of the corner piece includes a molded ridge shaped to follow an outer face of the extruded plastic strip so as to simulate the extruded plastic strip. Preferably the extruded plastic strip terminates behind the corner piece.

Preferably the strip is formed or molded to define a contour of the outer face. Materials such as hard wood or MDF can be used to maintain a traditional appearance.

The present arrangement can be used with the casing members formed of wood.

In a further feature, however the window can be finished using a vinyl casing formed of extruded casing material cut to length. As the size of the window is predetermined and set by the frame structure, it is possible to precut the members to the required lengths to accurately match the window, thus removing the necessity for onsite measuring, cutting and mitering.

When using a wood product, the casing for the door or window can be formed with two grooves, one at the door jamb for screwing the member to the jamb and the other spaced away from the jamb for screw fastening to the wall framing.

When using a vinyl or other extruded product, a hook portion extruded along the length of the strip or casing can be used to engage a suitable receptacle at the jamb with the groove and screw fastening arrangement used at the wall framing. In this way two point fastening is provided using only a single screw channel and a single hook portion.

Where the jamb is extruded, the receptacle can be formed along the length of the jamb as an extruded slot shaped to receive and contain the hook portion.

Where the jamb is formed of wood, a separate extruded element carrying the receptacle can be screwed onto an edge of the jamb.

Preferably the strip as defined above has an engagement portion along its length on the rear face thereof for engaging a corresponding element, the engagement portion on the rear face being parallel to and spaced transversely of the groove.

Preferably the corresponding element is provided in a jamb of a window or door so that the strip forms a casing or face plate for the window or door.

Preferably the corresponding element is provided on the jamb of a window or door by providing a separate extruded strip which is screwed to the jamb.

Preferably the corresponding element is provided on the jamb of a window or door by forming the corresponding element as an integral element in an extruded jamb.

Preferably the engagement portion along the rear face of the strip comprises a channel and the corresponding element comprises an insert strip portion insertable into the channel as a friction fit, which is insert strip portion is carried on an attachment flange member arranged for fastening along the jamb.

Preferably the strip is pre-formed to length to define the four sides of a casing for a window or three sides for a door.

According to another aspect of the invention there is provided the strip component of the combination for attachment as a casing to a window or door frame comprising:

a strip body having a rear face for placement against the frame, a front decorative face, an inside edge for placement adjacent the door or window edge and an outside edge spaced from the inside edge;

a first groove along the front face at a position closer to the outside edge;

a second groove along the rear face at a position closer to the inside edge, the first and second grooves being parallel.

According to a third aspect of the invention there is provided the extruded fastener strip component of the combination having two flanges at right angles for attachment to an edge of a frame member and an attachment fin along the flanges parallel to one of the flanges for engaging into a groove of a member to be fastened thereto.

BRIEF DESCRIPTION OF THE DRAWINGS

One embodiment of the invention will now be described in conjunction with the accompanying drawings in which.

DETAILED DESCRIPTION

Figure 1:
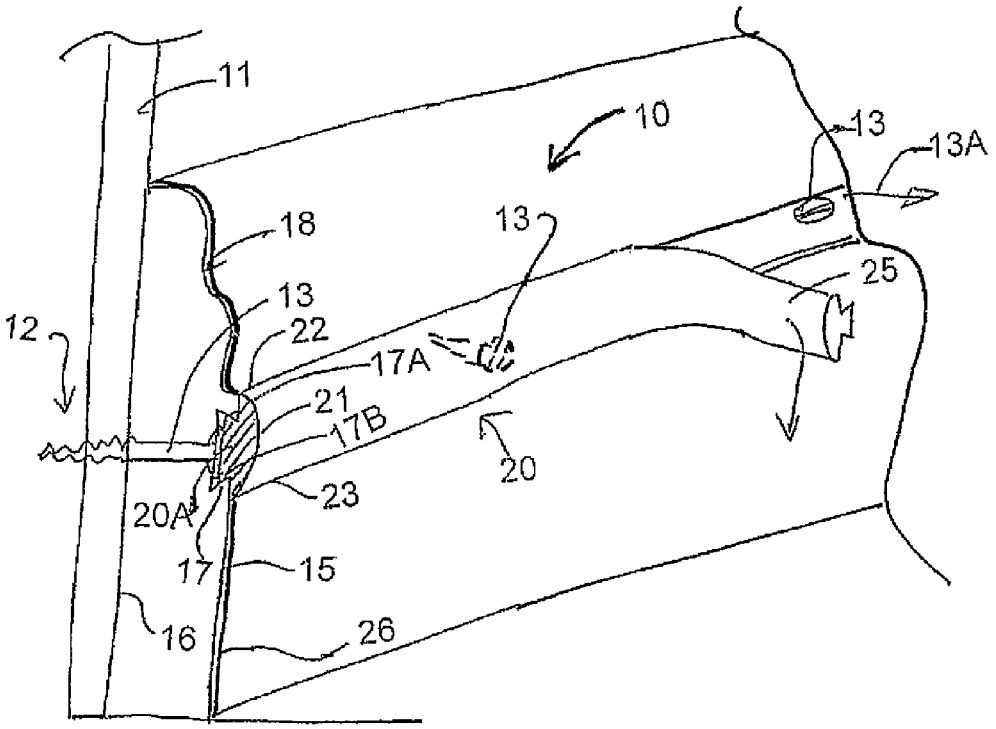
FIG. 1 is an isometric view partly in cross-section showing a strip or board fastened to a wall using the arrangement of the present invention.

A board or strip 10 is fastened to a wall 11 by screws 13 which extend through drywall 11 to studs 12. The board has a front or outer face 15 and a rear face 16 against the wall. The outer face 15 of the board has a contoured or shaped profile 18 with a continuously longitudinally extending groove 17. The rear face 16 of the board is fastened against the wall by a series of screws 13 at spaced positions along the board, the screws being recessed in the groove 17.

The groove and the screws therein are covered with an extruded plastic strip 20 inserted into the groove along the length of the board.

The strip 20 has an outer surface 21 which is domed in transverse cross-section and which tapers to an edge 22, 23 along respective sides of the groove. In this way the strip is shaped to smoothly join the contour 18 at the edge 22 so that the surface of the board and the strip are contiguous at the junction therebetween. The opposite edge can also be arranged to be contiguous or there may be a discontinuity in the curvature The groove has reverse tapered sides 17A and 17B so as to hold a base portion 20A, which is similarly tapered, of the strip as a snap fastening therein.

As shown at 25 the strip can be later removed and the board unscrewed as shown at 13A and removed to enable work to be carried out on the wall such as painting or wall covering. When completed, the board and the strip can be replaced in the same position over the paint or covering. Work on the adjacent floor can be carried out such as laying a floor covering and the board replaced at the same or more typically an adjusted position dependent on the thickness of the floor covering applied.

Typically the board is supplied in a finish paint condition as indicated at 26 so that when the strip is inserted the board is complete with no filling or finishing required.

In a situation where the strip is visible against the front face of the board, the strip can be formed in a deliberately different or contrasting color from the board and maybe arranged to match an adjacent color scheme of the wall or floor.

Figure 2:
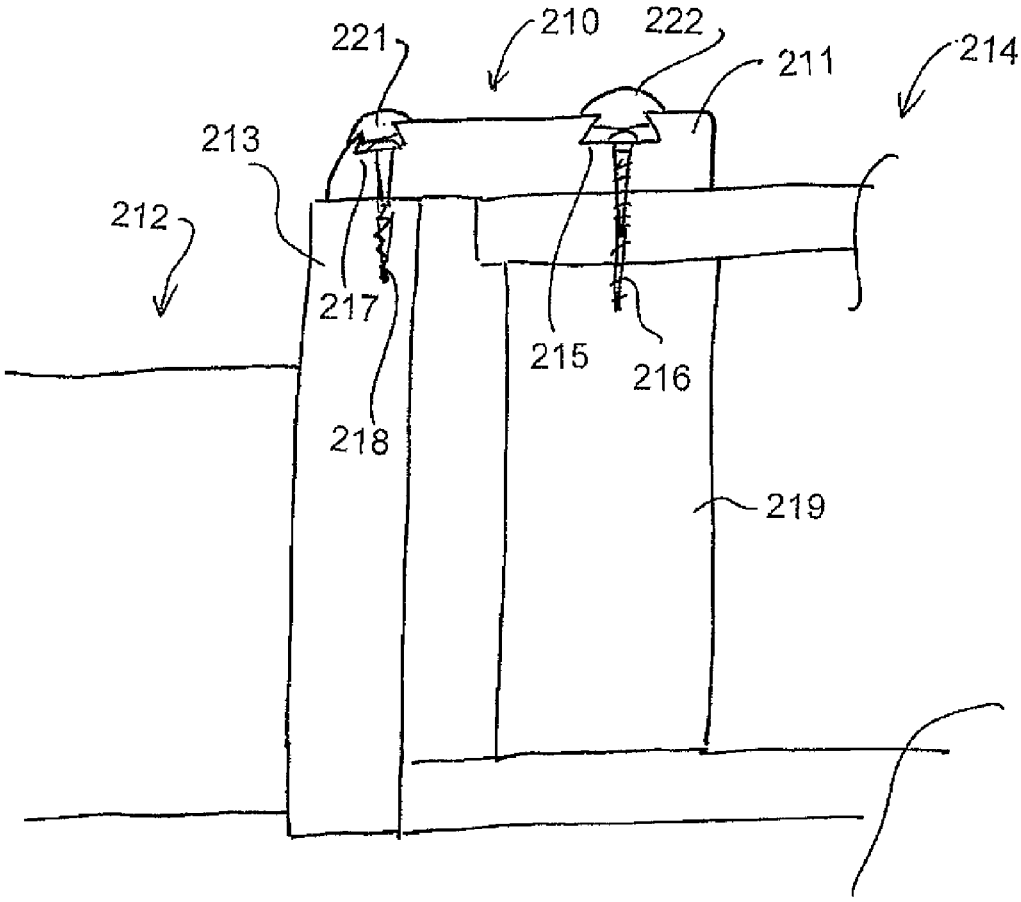
FIG. 2 is a cross-sectional view showing a board in the form of a face plate or casing for a window or door fastened both to a jamb and to a wall using the groove and screw arrangement of the present invention.

In FIG. 2 is a cross-sectional view showing a board 210 in the form of a face plate or casing for a window or door 212 fastened both to a jamb 213 and to a wall 214 using the groove 215 and screw 216 arrangement described above. In this arrangement the jamb 213 is of wood or other material which will take a screw fastening. In this arrangement the face plate or board 211 is of a wood product and has two parallel grooves 215 and 217 at spaced positions so that the screw 218 from one engages into the jamb and the screw 216 from the other engages into the wall framing 219 spaced from the jamb. In this way the plate is properly anchored and is held down against the jamb and against the wall cladding. As previously described the board 211 can be removed and replaced by removing the extruded cap strips 221 and 222 and by unfastening the screws. This allows adjustment or more typically easier painting and decorating.

Figure 3:
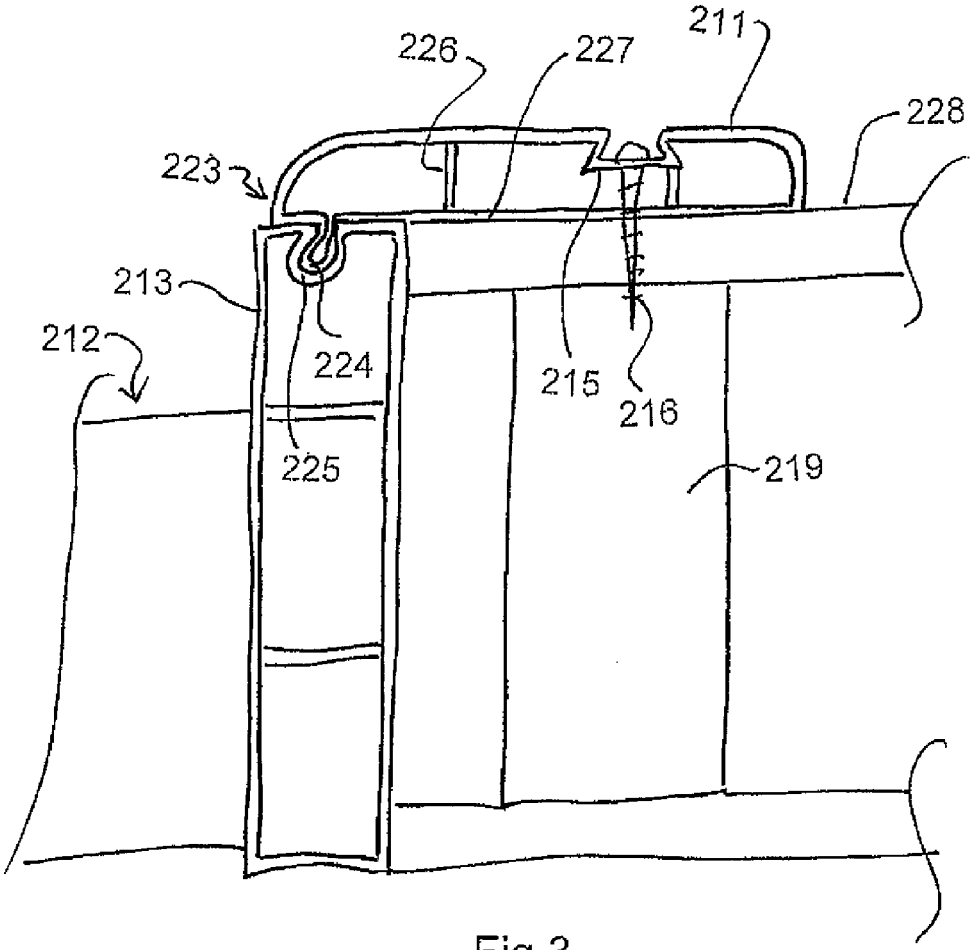
FIG. 3 is a cross-sectional view similar to that of FIG. 2 showing a board in the form of a face plate or casing formed of an extruded material for a window or door fastened to a jamb of the window by a hook portion and to a wall at a position spaced from the jamb using the groove and screw arrangement of the present invention.

In FIG. 3 is a cross-sectional view similar to that of FIG. 2 showing a board 211 in the form of a face plate or casing formed of an extruded material typically vinyl for a window or door. In this case the extruded product is fastened to a jamb 213 of the window by a hook portion 223 and to a wall at a position spaced from the jamb using the groove 215 and screw 216 arrangement of the present invention. The hook portion is formed on the board 211 as an extruded member 224 along the edge adjacent the jamb 213 and the receptacle 225 for that hook portion is formed as an extruded channel in the extruded jamb 213. The hook portion 224 and receptacle 225 are shaped to cooperate in allowing pivotal insertion which allows the hook 224 to hold the plate firmly against the jamb. That is the hook 224 is curved so that it is inserted with the board 211 rotated counter clockwise from the position shown and then the board 211 is rotated to its installed position causing the hook to enter the receptacle 225 and the rear face 227 of the board 211 to sit on the wall board 228 for fastening of the screw 215 and insertion of the strip. The extruded board 211 and the extruded jamb 213 are both hollow with bridging reinforcing bars 226 across the hollow interior in a common manner used in such vinyl products.

Figure 4:
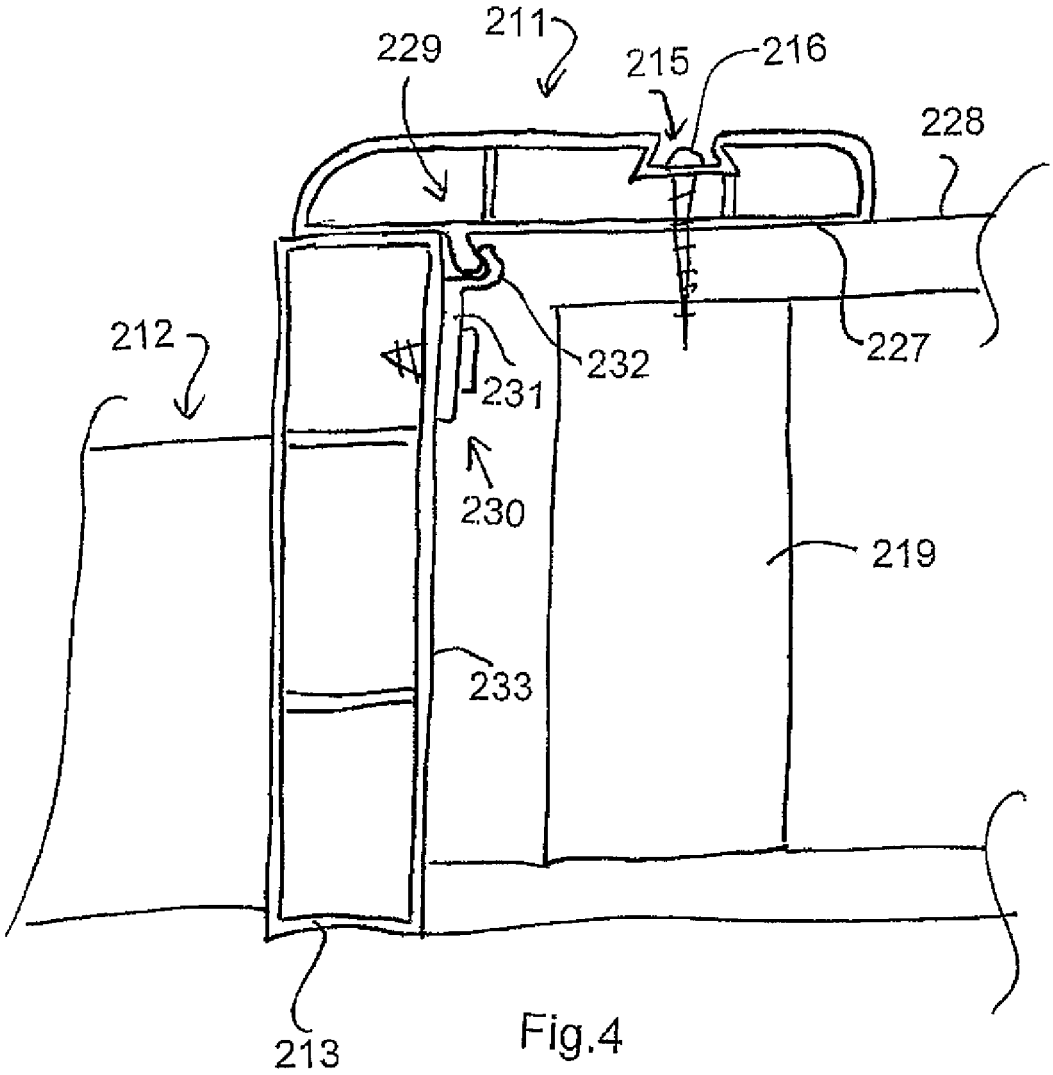
FIG. 4 is a cross-sectional view similar to that of FIG. 2 showing a board in the form of a face plate or casing formed of an extruded material for a window or door fastened to a jamb of the window by a hook portion and to a wall at a position spaced from the jamb using the groove and screw arrangement of the present invention.

FIG. 4 is a cross-sectional view similar to that of FIG. 2 showing a board 211 in the form of a face plate or casing formed of an extruded material for a window or door fastened to a jamb 213 of the window by a hook portion 229 and to a wall at a position spaced from the jamb using the groove 215 and screw 216. In this case the receptacle 230 for the hook portion 229 is provided on the jamb 213 by fastening a plate 231 carrying the receptacle 232 to a side face 233 of the jamb thus presenting the receptacle 232 at the outer edge of the jamb 213 on the side away from the window or door 212. Again the hook portion 232 holds the board 211 against the jamb 213. A groove and screw arrangement attaches the board 211 to the wall frame 219. In this arrangement the board 211 is extruded so that the channel 215 for the screw is formed as an extruded channel directly in the board 211.

Figure 5:
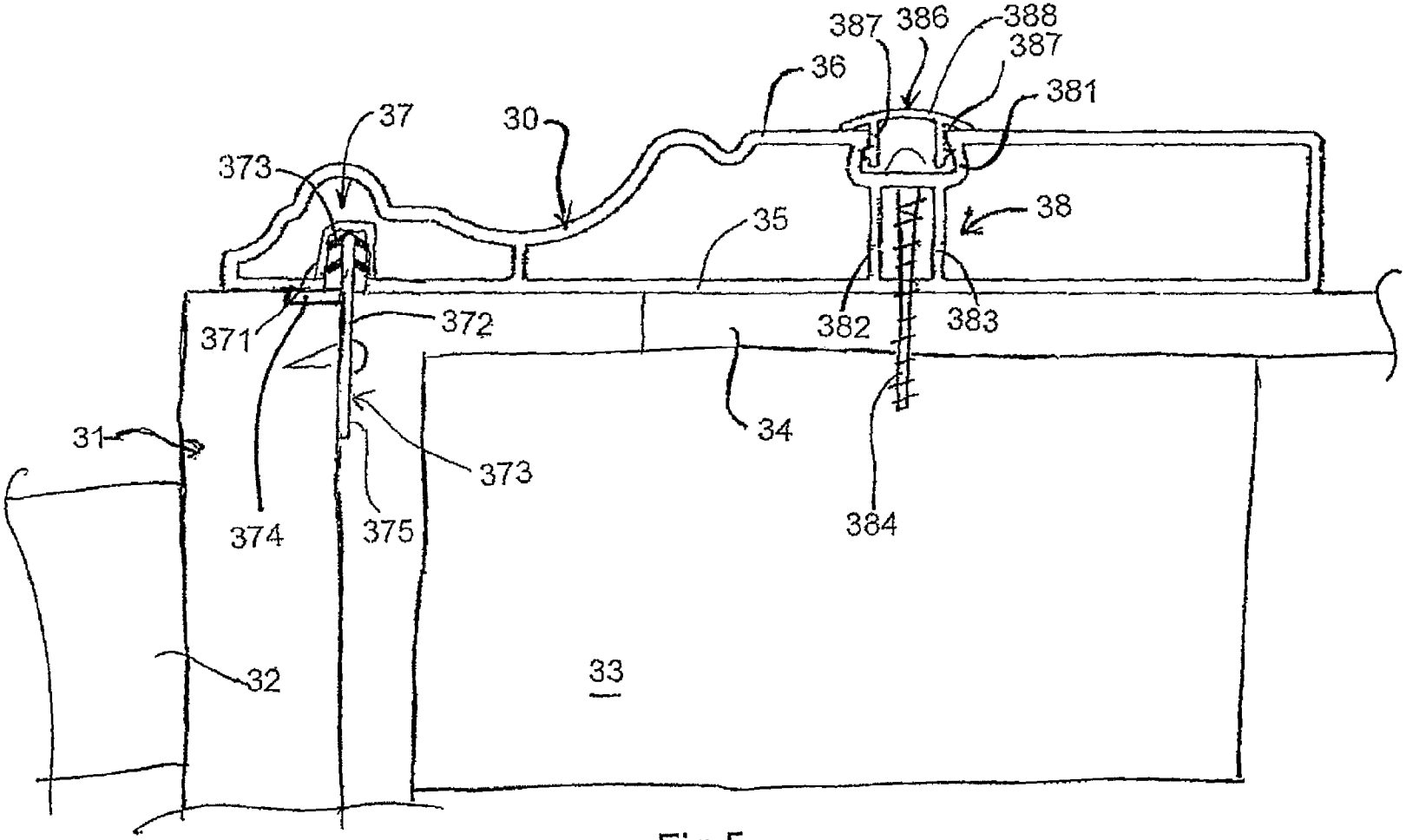
FIG. 5 is a cross-sectional view similar to that of FIG. 3 showing a modified arrangement in which the strip is attached by a finned extrusion into a groove in the extruded type strip.
Figure 6:
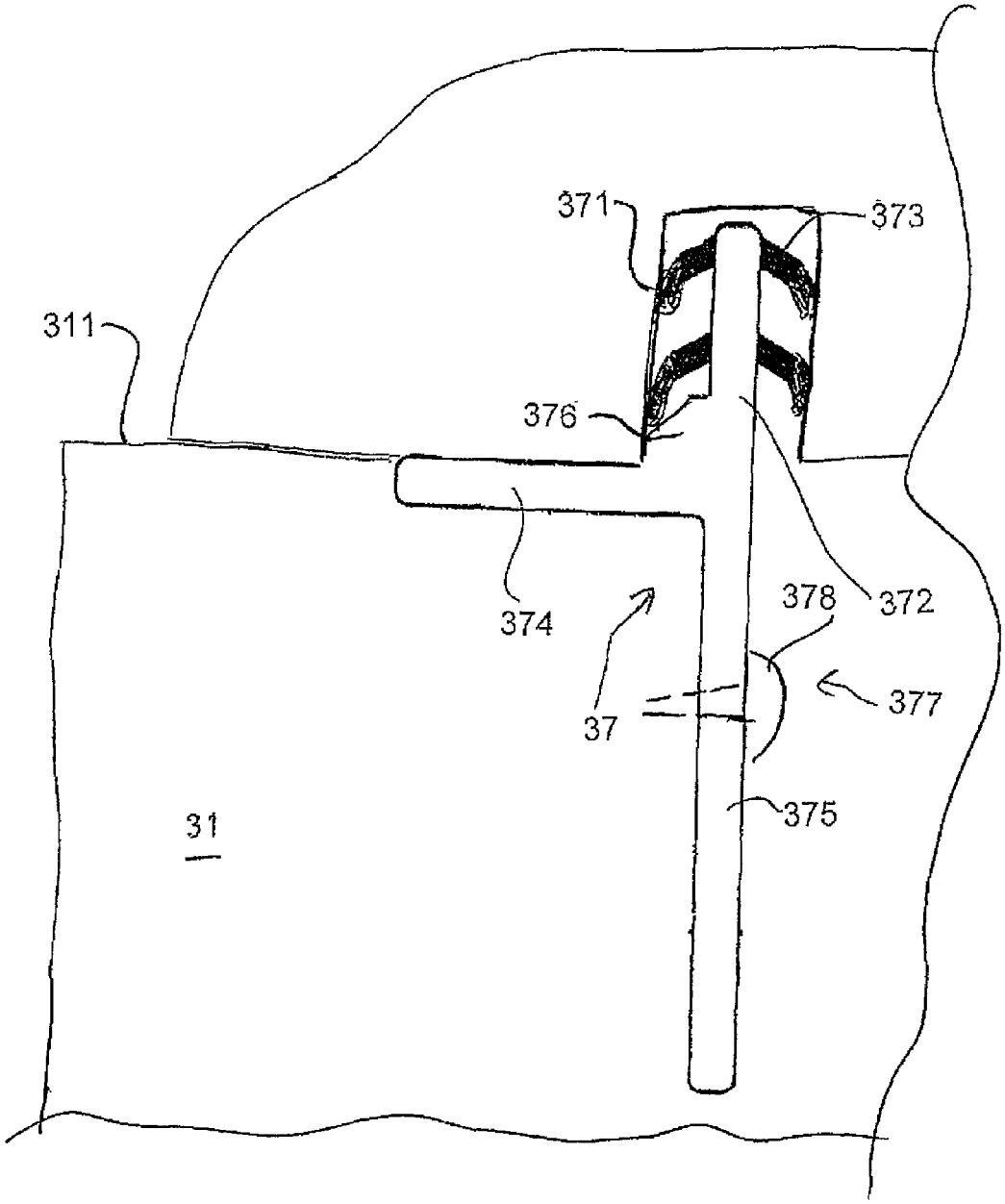
FIG. 6 is an enlarged cross-sectional view showing the same construction using a wood type product as the strip.

In FIGS. 5 and 6 is shown a further embodiment for a casing 30 for a door or window jamb 31. The strip forming the casing 30 is extruded from a suitable material as shown in FIG. 5 or can be molded from a solid material such as wood, MDF or other wood type product as shown in FIG. 6.

The extruded board 30 is attached to the jamb 31 and the a frame member 32 and studs or frame members 33 at the drywall or other cladding 34.

The board 30 has a rear face 35 butting against the wall surrounding the window or door opening 32 against the jamb 31. The board 30 has a front face 36 providing a decorative appearance which may be contoured as shown or may be plane as preferred and may include a coating. The board 30 covers the edge of the drywall 34 at the jamb 31.

The board 30 is fastened by a screw and groove coupling 38 as previously described at a position on the frame 33 spaced from the jamb 31 and by a separate fastener system 37 at the jamb 31.

The screw and groove coupling 38 comprises a groove 381 formed in the front face 36 along the full length of the board 30. In the extruded embodiment shown, the groove 381 is supported on each side by a support wall 382, 383 bridging to the rear face 35. In the solid wood product, the groove 381 is machined into the front face.

At spaced positions along the groove 381 is provided a series of screw fasteners 384 with the head within the groove and the body screwed into the frame 33. The screws are then covered by an extruded facing strip 386 snapped into the groove by two parallel legs 387 and including a domed strip 388 attached to the legs and extending over and across the groove.

The separate fastener system 37 includes a groove 371 formed in the rear face 35 of the board 30 into which is inserted an arrow shaped blade 372 with side fins 373 to hold the components together as a friction fit. The blade 372 includes a wedge 376 on the blade 372 to engage the side wall of the groove 371 to locate the blade against side to side movement in the groove. The blade 372 has two arrow shaped heads with side lips or fine 373 for engaging the sides of the groove 371 in a friction fit to hold that edge of the board 30 in place. The blade 372 is extruded as an integral part of a holding bracket 377 with two flanges 374 and 375 at right angles and fastened to the inside corner of the frame member 32 by screws 378 at spaced positions along the leg 375.

In FIG. 6 is shown the same construction as FIG. 5 on an enlarged scale where the strip is a solid wood product and the groove 371 is machined into the body.

The main holding action is effected by the screws 384. However the blade 372 acts to ensure that the edge of the board 30 at the jamb 31 is held tight against the front face 311 of the jamb 31. The board 30 can be removed and replaced for repainting if required by removing the cap 386, removing the screws 384 and pulling the coupling 37 apart by force against the friction fit.

Turning now to FIGS. 7 to 15 there is shown a plurality of arrangements for corner members between the strip members to provide a system which can be quickly and easily installed at minimum of on site labor.

Figure 7:
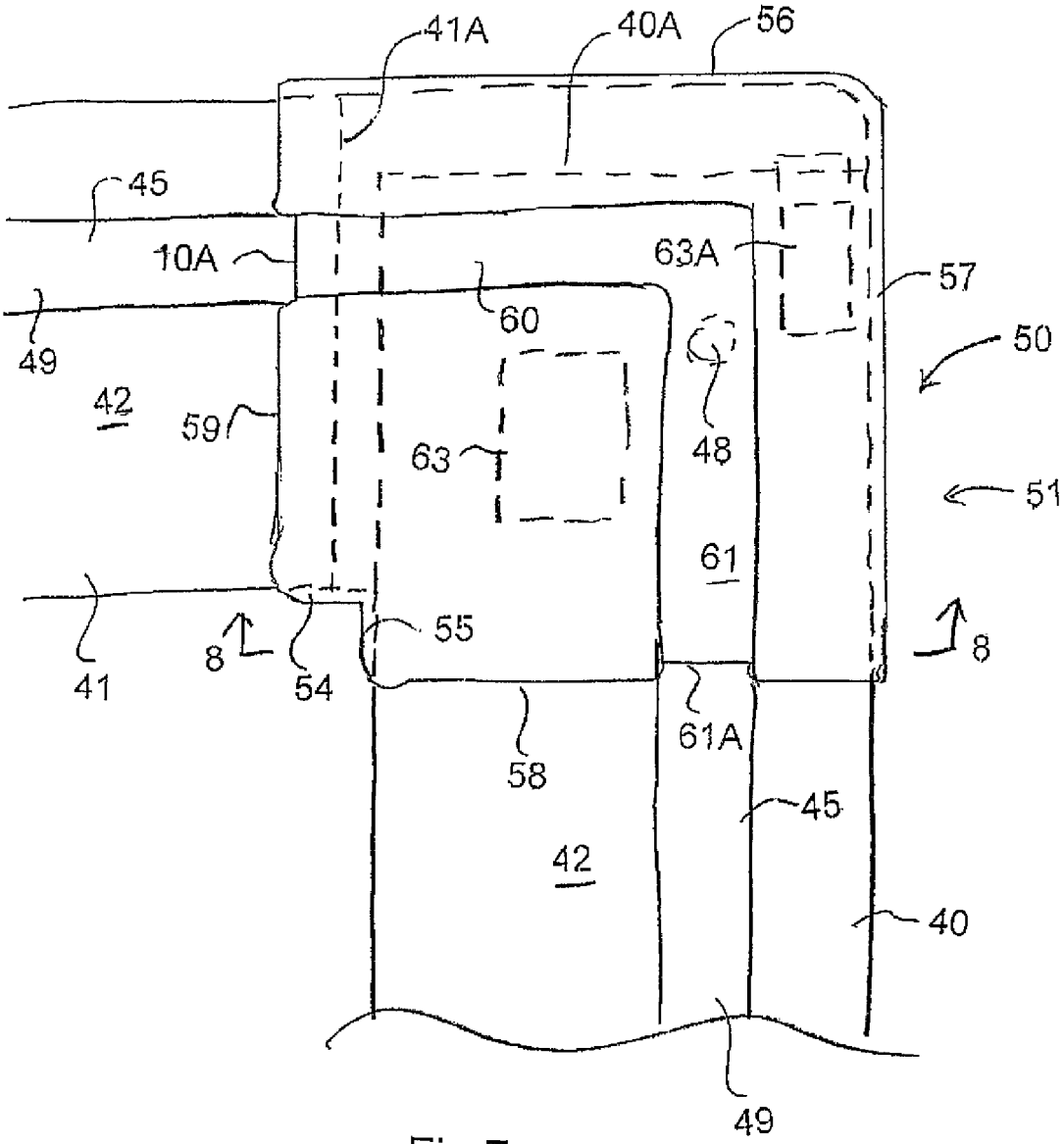
FIG. 7 is a front elevational view of one embodiment of corner between two strips of a casing using the arrangement shown in FIG. 5.
Figure 8:
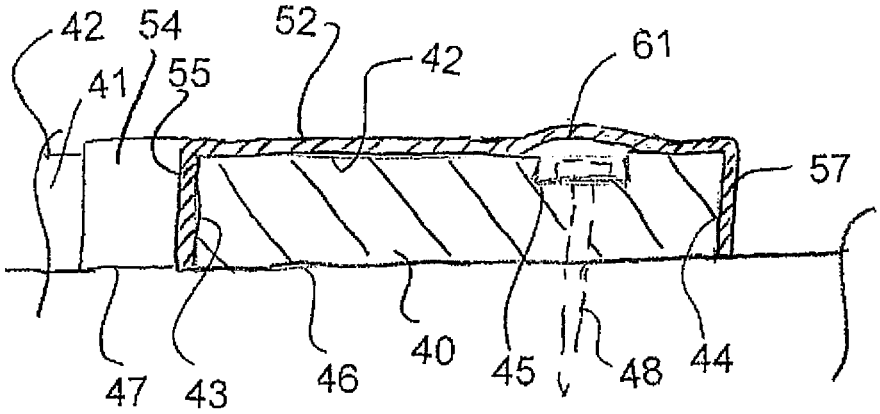
FIG. 8 is a cross-sectional view along the lines 8-8 of FIG. 7.
Figure 9:
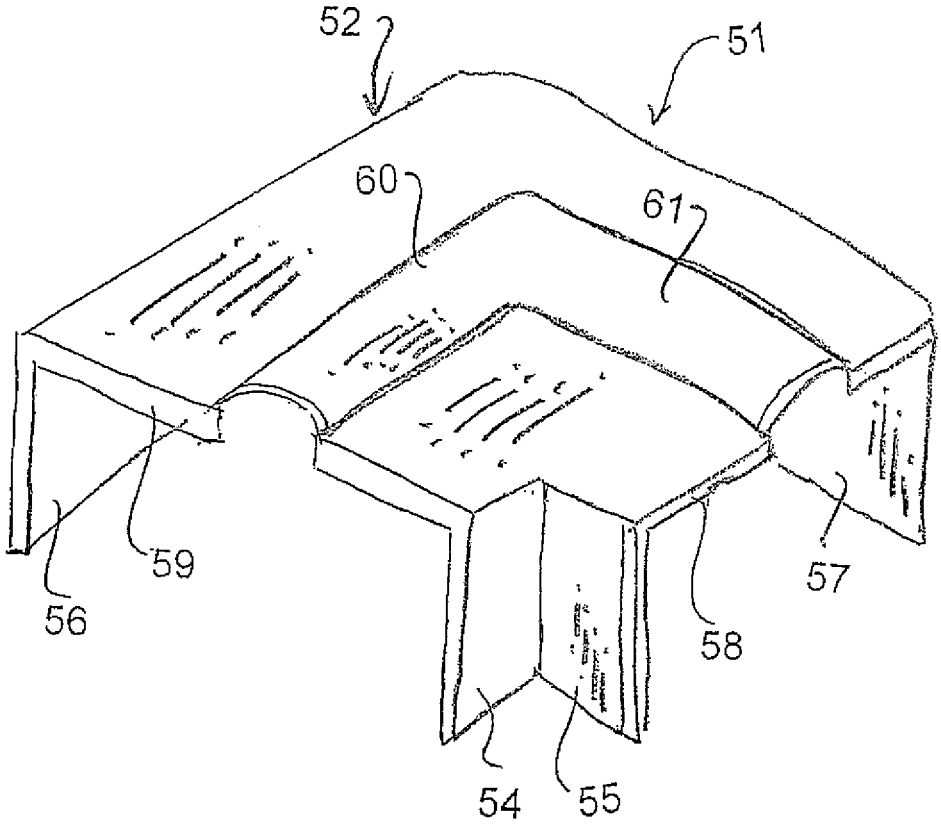
FIG. 9 is an isometric view of the molded corner piece of the corner of FIG. 7.

Thus as shown in FIGS. 7, 8 and 9 there is shown first and a second elongate stiff decorative strips 40 and 41 of the type shown in FIG. 1 or FIG. 5 and including all of the components previously described.

Each strip has a front face 42 which is arranged to be exposed along the edge of the wall or walls. Each strip has at least one side edge 43, 44 at right angles to the wall and to the front face 42. Each strip has in the outer face 42 of the strip a continuously longitudinally extending groove 45 so that a rear face 46 of the strip is fastened to the wall 46 by a series of screws 48 at spaced positions along the strip. The screws 48 are recessed in the groove 45 and there is provided an extruded plastic strip 49 arranged to be inserted into the groove 45 along the length of the strip 40, 41 covering the groove 45 and the screws 48 therein.

The first and second strips 40, 41 have ends 40A and 41A coming together at an angle at a corner generally indicated at 50. In this arrangement for forming a casing for a fenestration opening, that is a window or door, in the wall the strips 40, 41 meet at a corner of the casing where the front face 42 of the strips lie in a common plane parallel to the wall.

A molded corner piece 51 is provided covering the ends 40A and 41A of the first and second strips and provides a decorative cover at the corner 50 with a front face 52 of the corner piece 51 providing a contiguous continuation between the front face 42 of the first strip 40 and the front face 42 of the second strip 41.

Thus each of the strips has a contour or shape of the front face and the front face of the molded corner piece follows the contour so that it forms a continuation of the strips through the corner.

Each of the strips has the edge face or faces 43, 44 generally transverse to the front face 42 and the corner piece has inner edge wall 54, 55 covering the inner edge face at an end of each strip 40, 41 at the corner and outer edge wall 56, 57 covering the outer edge face at an end of each strip 40, 41. The corner piece 51 is hollow on the underside of the front wall 52 and inside of the side walls so that one of the strips that is strip 40 passes behind the front face. The end 40A thus projects well beyond the edge 58 of the front face 52 and is thus located closely adjacent the wall 56. The end 41A just projects into the hollow interior just beyond the edge 59.

In the arrangement of FIGS. 7, 8 and 9, the front face 52 of the corner piece 51 includes a molded ridge 60, 61 shaped to follow an outer face of the extruded plastic strip 49 in the groove 45 so as to simulate the extruded plastic strip. Thus the ridges 60 and 61 meet at a corner with the whole of the simulated strip being formed artificially as a molded shape of the front face 52 rather than as an actual strip. The ridges 60 and 61 terminate at ends 60A, 61A which are recessed from the respective edges 58 and 59 of the front face 52. In this way, the extruded plastic strip 49 can extend into a hollow area behind the ridges 60 and 61 so as to terminate behind the corner piece. This avoids cutting the strips 49 accurately to length since the corner piece covers the ends of the strips 40 and 41 and the strips 49 and provides a simple termination for these components while providing an attractive front face 52. This avoids much labor in cutting the strips to length and in forming mitered corners to the strips. As the strip 40 extends behind the hollow of the corner piece, its front face provides a support for the rear face of the corner piece allowing the corner piece to be fastened the strip 40 by pieces of double sided adhesive tape 63 and 63A and suitable locations. Thus the molded piece has a rear face fastened by adhesive to a suitable support plate which can be hidden behind the corner piece.

Figure 10:
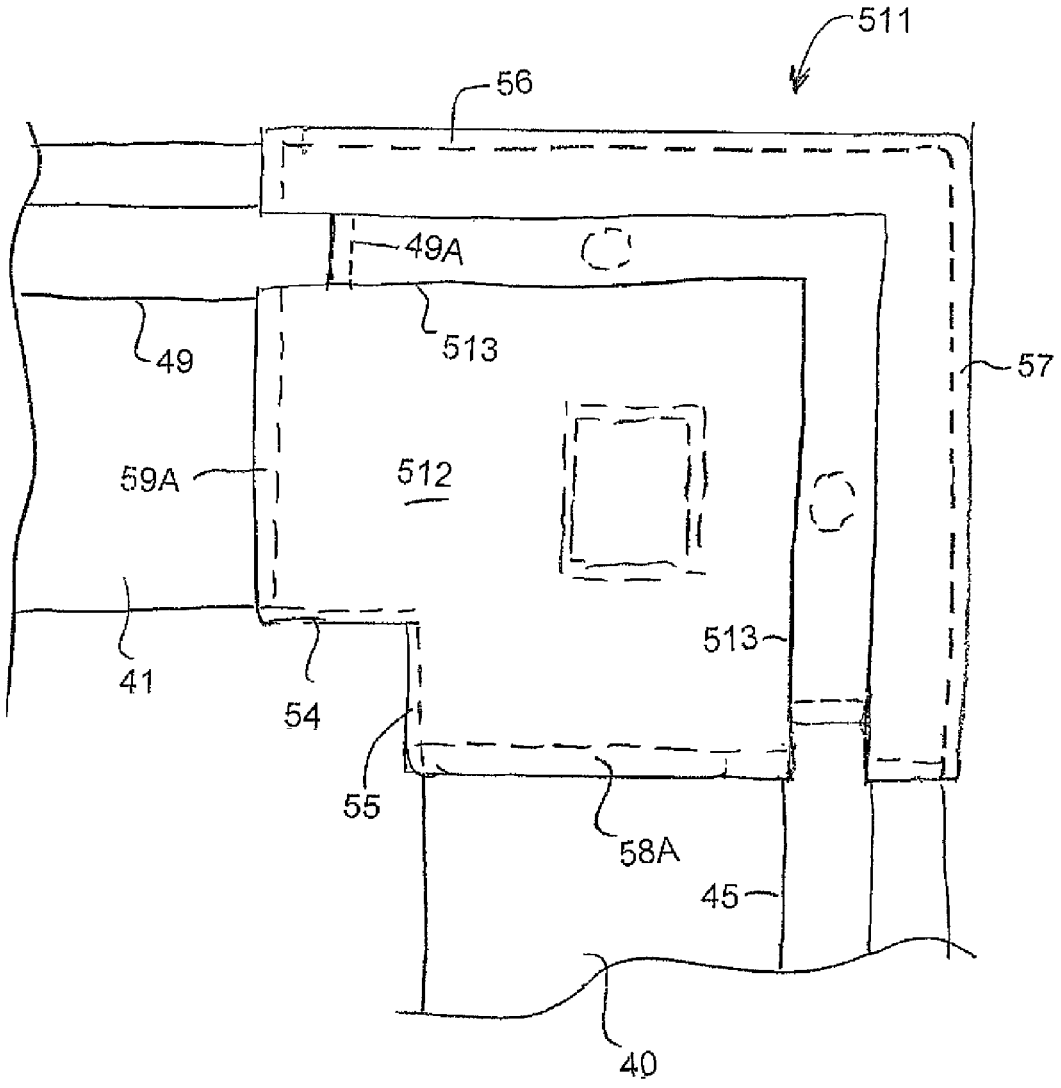
FIG. 10 is a front elevational view of a second embodiment of corner similar to that of FIG. 7 between two strips of a casing using the arrangement shown in FIG. 5.
Figure 11:
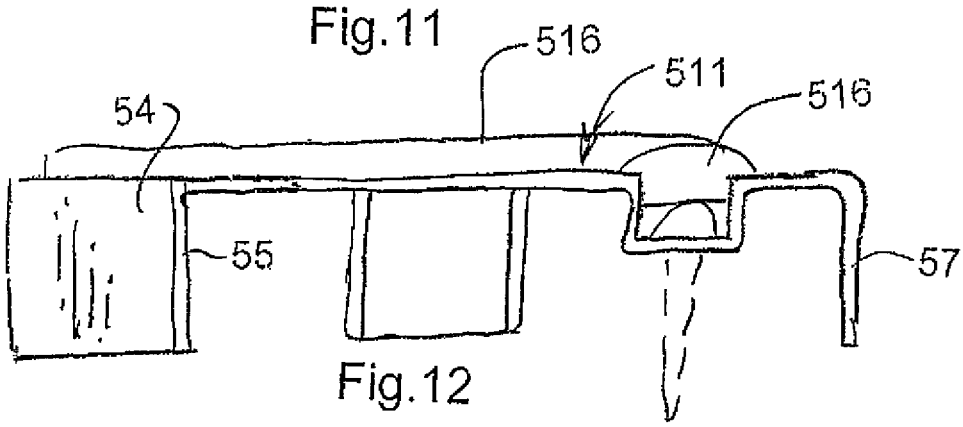
FIG. 11 is a top plan view of the molded corner piece of the corner of FIG. 10.
Figure 12:
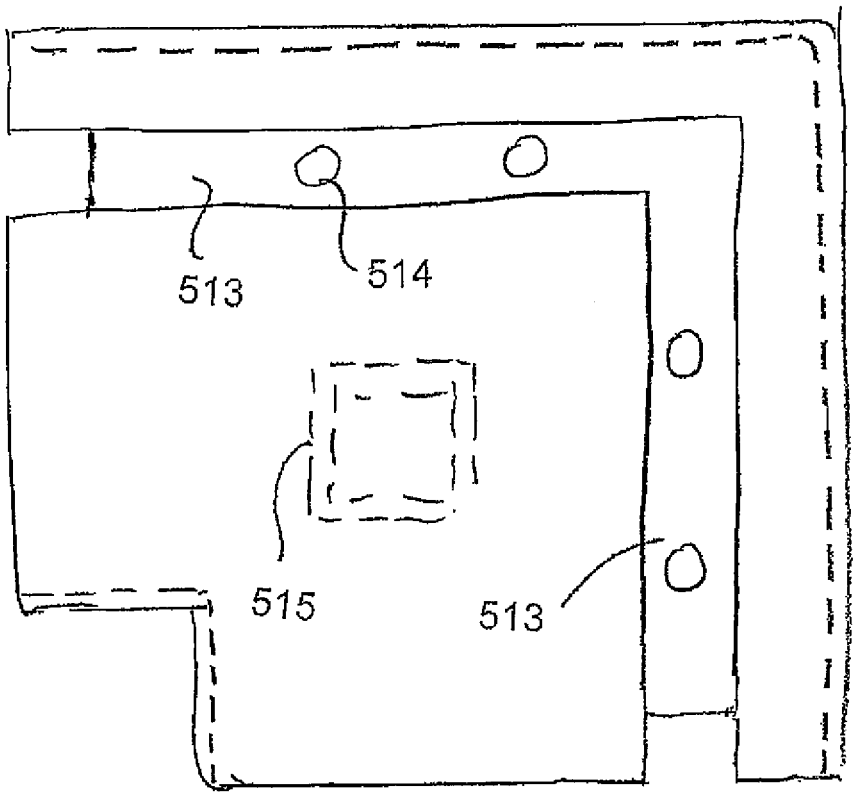
FIG. 12 is a front elevational view of the molded corner piece of the corner of FIG. 10.

Turning now to FIGS. 10, 11 and 12, there is shown a corner piece 511 similar to corner piece 51 with a front face 512. The edges 58A and 59A I this embodiment are chamfered so that they meet the strips 40 and 41 at a sharp edge. In this embodiment, the front face 512 of the corner piece includes an actual groove 513 which is contiguous with the groove 45 in the strips 40, 41. There is provided a molded plastic strip portion 516 which is a right angle piece with two legs meeting at a corner for simulating the extruded plastic strip 49 and arranged to engage into the groove 513 of the corner piece 511. The groove 513 is shaped such that the end 49A of the extruded plastic strip 49 extends from the groove 45 in the strip 41 into the groove 513 in the corner piece behind the molded piece 516. The corner piece 511 is fastened to the wall by screws through holes 514 recessed in the groove 513 of the corner piece so as to be covered by the molded strip 516. The corner piece includes a support leg 515 within the hollow interior of the corner piece to butt the wall with the bottom edges of the walls 54, 55, 56 and 57 hold the corner piece from collapsing when the screws are inserted.

Figure 13:
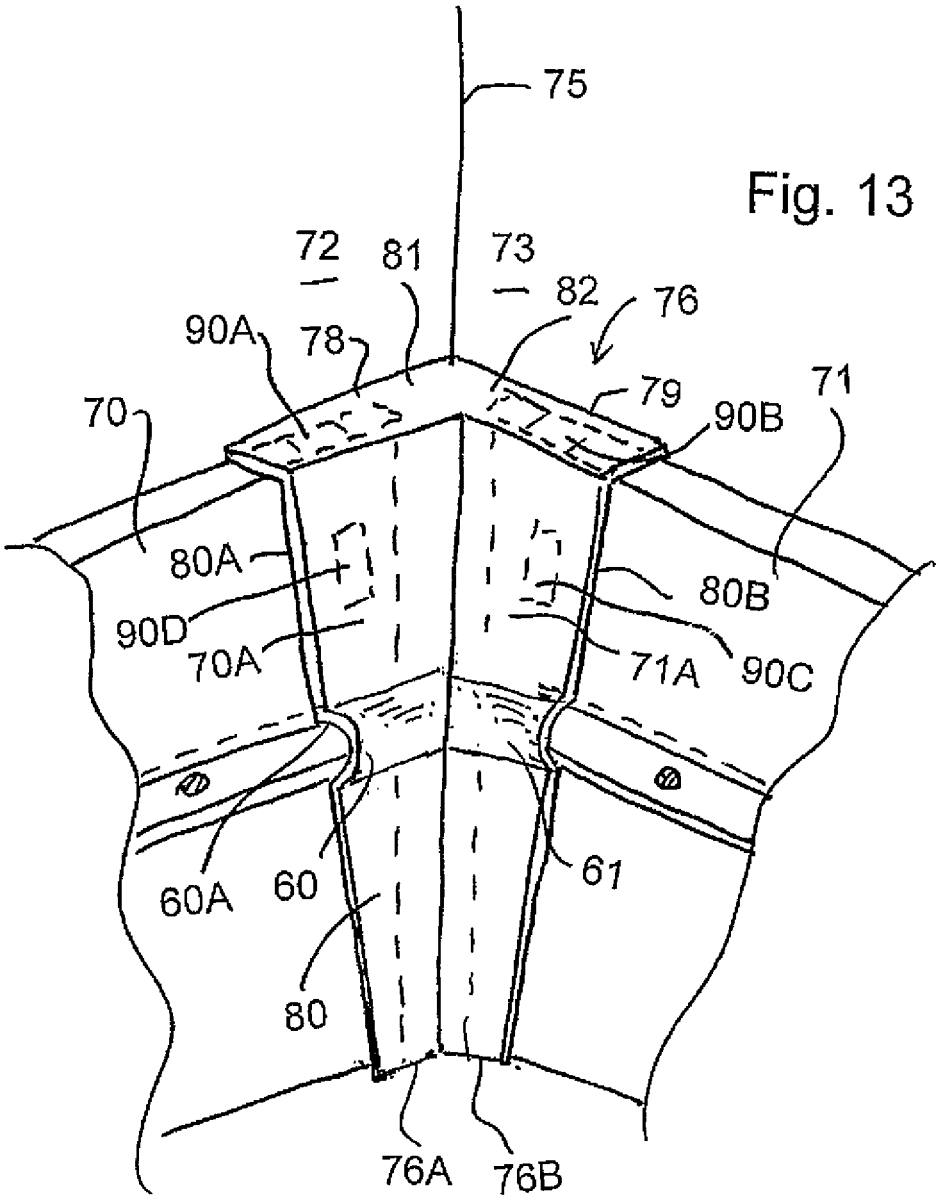
FIG. 13 is an isometric view of a right angle inside corner between two base board pieces using the arrangement of FIG. 1.
Figure 14:
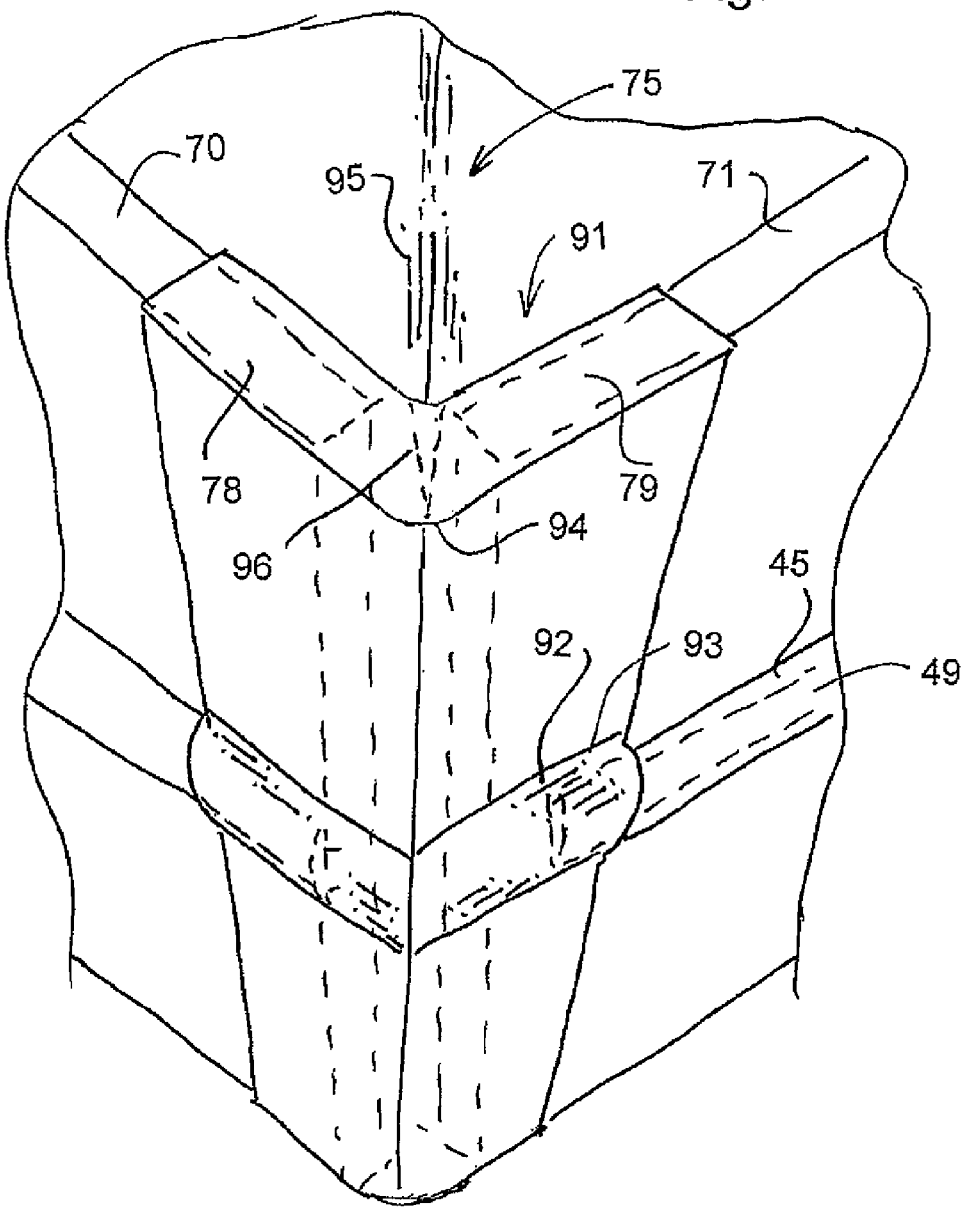
FIG. 14 is an isometric view of a right angle outside corner between two base board pieces using the arrangement of FIG. 1 and showing a number of modifications relative to FIG. 13.

Turning now to FIGS. 13 and 14, there is shown a pair of base boards 70 and 71 fastened at the bottom of walls 72 and 73 at an angle, generally right angle, to one another where the boards meet at a corner 75 between the two walls 72 and 73, In this case there is provided a corner piece 76 similar in construction and operation to the corner piece of FIG. 7 which includes two portions 78 and 79 at the right angle of the corner with each portion 78, 79 overlying a respective one of the boards 70, 71 and receiving an end 70A, 71A thereof. The corner piece includes a front face 80 and two top edges 81, 82. In FIG. 13, the molded corner piece 76 includes a raised arched ridge 60, 61 similar to that of FIG. 9 to simulate the strips 49.

The arched ridge 60, 61 molded into the front face 80 is slightly greater in dimension than the strip 49 so that the strip 49 can extend behind the inner surface 60A at the molded ridge into the area behind the molded corner piece.

The corner piece 76 forms edges 80A, 80B along the corner piece which are visible at the front face of the boards 70, 71. The edges 80A and 80B may be chamfered. The edges 80A and 80B may be tapered inwardly toward the bottom of the corner piece 76 so that the length of the corner piece at the top edges 78 and 79 is greater than the length of the corner piece at the bottom edges 76A, 76B. This taper effect assists in allowing slight distortion of the corner piece from the square or right angle if the corner 75 is poorly constructed and out of a true right angle. The intention is to keep the molded corner piece as close as possible to the front face and top face of the boards 70, 71 so that there is no gap which could form an unsightly crack at the edge 80A. This is achieved by applying adhesive preferably as double sided tape pieces 90A to 90D at the top and front faces of the boards In FIG. 14, there is shown an external right angle corner piece 91. The corner piece is similar to that of FIG. 13 however the corner piece 91 includes a groove 92 following the grooves 45 of the baseboards with an injection molded filler piece 92 inserted into the groove 92 of the corner piece simulating the strip 49 of the boards 70, 71.

The corner piece 91 includes a curved corner edge 94 following ad simulating the curved edge at the drywall of the corner 75. Thus the corner piece can be used for curved drywall corners as has become widely used in recent years.

In the event that the corner 75 is inaccurately formed, a triangular nick 96 can be cut out at the junction of the top edges 78, 79 to allow these to be moved inwardly to reduce the angle therebetween from a right angle.

In addition to the base boards and fenestration boards shown above, the same system can be used for casing mirrors in a vanity. Thus the top and bottom rails containing the edge of the mirror and acting to support the mirror are fastened using screws through the groove 45 into studs of the wall and covered by the strips 49. The side rails containing the edge of the mirror also include the same grooves 45 and strips 49 for the same aesthetic appearance but are fastened onto the wall using double sided tape since they carry no load. Molded corner pieces of the type shown in FIG. 7 are used.

The invention claimed is:

1. Apparatus for trimming interior surfaces of a building comprising:

a plurality of fenestration jamb members including a first and a second jamb member arranged at right angles for surrounding a fenestration opening;

each of the jamb members providing a front face located at an edge of one of the interior surfaces;

a plurality of elongate facing boards;

each facing board having a front face defining an attractive edge face and a rear face for fastening to the surface;

each of the first and second jamb members having associated therewith a respective first and second facing boards of the elongate facing boards mounted on a respective one of the interior surfaces along the edge of the surface for forming the attractive edge face of the surface;

each facing board having an inner edge facing inwardly along the surface and an outer edge located at the front face of the jamb member;

each facing board having in said front face of the board at a position spaced from the front face of the jamb member a continuously longitudinally extending groove;

the groove having a base recessed from the front face;

the groove having a first side edge in said front face at a position spaced from said inner edge of the board and a second side edge on said front face at a position spaced from the outer edge of the board;

the rear face of the board being fastened to the surface by a series of screws at spaced positions along the base of the groove of the board with the screws being recessed in the groove from the front face of the board;

and an extruded plastic strip inserted into the groove along the length of the board and covering the groove and the screws therein;

wherein the extruded plastic strip has a cap portion outside the groove and an insert portion extending into the groove;

the groove having a first side wall extending from the base to the first side edge and a second side wall extending from the base to the second side edge;

the first and second side walls being shaped to cooperate with a respective side edge of the insert portion of the extruded plastic strip to restrain the insert portion against movement out of the groove;

the cap portion having first and second side edges and an outer surface therebetween;

the first side edge of the cap portion being located on the front face of the board at a position spaced from the first side edge of the groove toward but spaced from said inner edge of the board;

the second side edge of the cap portion being located on the front face of the board at a position spaced from the second side edge of the groove toward but spaced from said outer edge of the board;

and a connection element, which is separate and spaced from the screws, connecting the board to the respective jamb member;

wherein the connection element includes a first component on the rear face of the board and a second component on the jamb member;

and wherein one of the first and second components comprises a receptacle and the other of the first and second components comprises an insert member for engagement into the receptacle.

2. The apparatus according to claim 1 wherein the jamb member comprises a cut length of an extruded body.

3. The apparatus according to claim 2 wherein the second component on the jamb member comprises an element formed as an integral component of the extruded body.

4. The apparatus according to claim 1 wherein the first component on the rear surface of the facing board comprises a channel extending longitudinally of the board and the second component on the jamb comprises an insert strip portion extending longitudinally of the iamb inserted into the channel as a friction fit.

5. The apparatus according to claim 4 wherein the insert strip portion has arrow shaped fins engaging side walls of the groove.

6. The apparatus according to claim 1 wherein the outer surface of the cap portion is domed in transverse cross-section so as to extend forwardly proud of the front face of the facing board.

7. The apparatus according to claim 6 wherein the domed outer surface of the cap portion tapers to a sharp edge at the front face of the facing board.

8. The apparatus according to claim 1 wherein the first and second side walls of the groove are tapered such that the spacing therebetween increases toward the base.

9. The apparatus according to claim 1 wherein each of the first and second facing boards is a different color from the strip.

10. Apparatus for trimming interior surfaces of a building comprising:

a plurality of fenestration jamb members including a first and a second jamb member arranged at right angles for surrounding a fenestration opening;

each of the jamb members providing a front face located at an edge of one of the interior surfaces;

a plurality of elongate facing boards;

each facing board having a front face defining an attractive edge face and a rear face for fastening to the surface;

each of the jamb members having associated therewith a respective one of the plurality of elongate facing boards mounted on a respective one of the interior surfaces along the edge of the surface for forming the attractive edge face of the surface;

a connection element for connection of the board to the respective jamb member including a first longitudinally continuous component extending along the rear face of the board and a second longitudinally continuous component extending along the jamb member;

wherein one of the first and second components comprises a channel and the other of the first and second components comprises an insert member for engagement into the channel;

wherein the jamb member comprises a cut length of an extruded body;

and wherein the second longitudinally continuous component on the jamb member comprises an element formed as an integral component of the extruded body.

11. The apparatus according to claim 10 wherein the component on the rear surface of the facing board comprises a channel and the component on the jamb comprises an insert strip portion inserted into the channel as a friction fit.

12. The apparatus according to claim 11 wherein the insert strip portion has arrow shaped fins engaging side walls of the channel.

13. The apparatus according to claim 10 wherein there is provided a separate attachment member separate from components and spaced from the jamb member attaching the facing board to the surface at a position spaced from the jamb member.

14. Apparatus for trimming interior surfaces of a building comprising:

a plurality of elongate facing boards;

each facing board having a front face defining an attractive edge face and a rear face for fastening to the surface and first and second side edges;

each facing board having in said front face of the board at a position spaced from the first and second side edges a continuously longitudinally extending groove;

the groove having a base recessed from the front face;

the groove having a first side edge in said front face at a position spaced from said first edge of the board and a second side edge on said front face at a position spaced from the second edge of the board;

the rear face of the board being fastened to the surface by a series of screws at spaced positions along the base of the groove of the board with the screws being recessed in the groove from the front face of the board;

each facing board having an extruded plastic strip inserted into the groove along the length of the board and covering the groove and the screws therein;

wherein the extruded plastic strip has a cap portion outside the groove and an insert portion extending into the groove;

the groove having a first side wall extending from the base to the first side edge and a second side wall extending from the base to the second side edge;

the first and second side walls being shaped to cooperate with a respective side edge of the insert portion of the extruded plastic strip to restrain the insert portion against movement out of the groove;

the cap portion having first and second side edges and an outer surface therebetween;

the first side edge of the cap portion being located on the front face of the board at a position spaced from the first side edge of the groove toward but spaced from said first edge of the board;

the second side edge of the cap portion being located on the front face of the board at a position spaced from the second side edge of the groove toward but spaced from said second edge of the board;

each of the facing boards having a longitudinally continuous channel extending along the rear surface thereof at a position thereon spaced from the screws;

and a plurality of connection elements each associated with a respective one of the facing boards connecting the board to the respective interior surface;

each of the connection elements being separate and spaced from the screws;

each of the connection elements including a longitudinally continuous insert strip portion extending along the interior surface and inserted into the channel as a friction fit.

15. The apparatus according to claim 14 wherein the insert strip portion has arrow shaped fins engaging side walls of the channel.

* * * * *